US005543745A

United States Patent [19]

Notani

[11] Patent Number: 5,543,745

[45] Date of Patent: Aug. 6, 1996

[54] VOLTAGE CONTROLLED CURRENT SOURCE AND BIAS GENERATION CIRCUIT USING SUCH CURRENT SOURCE

[75] Inventor: Hiromi Notani, Hyogo, Japan

[73] Assignee: Mitsubishi Denki Kabushiki Kaisha, Tokyo, Japan

[21] Appl. No.: 430,675

[22] Filed: Apr. 28, 1995

[30] Foreign Application Priority Data

Jun. 3, 1994 [JP] Japan ..... 6-122521

[51] Int. Cl.[6] ..... G05F 1/10

[52] U.S. Cl. ..... 327/538; 327/103; 327/540; 327/541; 327/543; 323/315

[58] Field of Search ..... 327/103, 277, 327/278, 281, 538, 540, 541, 543, 545, 546; 323/312, 313, 315

[56] References Cited

U.S. PATENT DOCUMENTS

| | | | |
|---|---|---|---|
| 4,342,926 | 8/1982 | Whatley | 327/541 |
| 4,558,242 | 12/1985 | Tuthill et al. | 327/437 |
| 4,717,845 | 1/1988 | Dunn | 326/71 |
| 4,922,141 | 5/1990 | Lofgren et al. | 327/277 |
| 5,012,133 | 4/1991 | Hughes | 327/91 |
| 5,302,920 | 4/1994 | Bitting | 331/45 |
| 5,432,389 | 7/1995 | Bader et al. | 327/538 |

FOREIGN PATENT DOCUMENTS

| | | | |
|---|---|---|---|
| 3342735 | 5/1984 | Germany | 327/103 |
| WO90/14712 | 11/1990 | WIPO | 327/543 |

*Primary Examiner*—Terry Cunningham
*Attorney, Agent, or Firm*—Lowe, Price, Leblanc & Becker

[57] ABSTRACT

Current $I_P$ through a transistor 2 linearly decreases according to control voltage $V_I$ in the range from 0 to $V_{DD}$–$V_{TP}$. Current $I_N$ through a transistor 3 linearly increases according to control voltage $V_I$ in the range from $V_{TN}$ to $V_{DD}$. In a subtraction/inversion circuit 5, constant current $I_{CONST}$ is introduced, $I_P$ is subtracted therefrom, and ΔI having an inclination in the same direction as $I_N$ is produced. Bias current $I_B$ serially changing in the range of $V_I$ from 0 to $V_{DD}$passes through a transistor 7. Accordingly, even if control voltage $V_I$ is smaller than the threshold voltage $V_{TN}$ of an input transistor, current $I_B$ or voltages $V_{PP}$ and $V_{BN}$ which linearly change according to control voltage $V_I$ are output.

8 Claims, 5 Drawing Sheets

VOLTAGE CONTROLLED CURRENT SOURCE AND BIAS GENERATION CIRCUIT USING SUCH CURRENT SOURCE

BACKGROUND OF THE INVENTION

1. Field of the Invention

The present invention relates to voltage controlled current sources and bias generation circuits using such a current source. The invention relates more particularly to a voltage controlled current source outputting a current according to a control voltage and a bias generation circuit outputting a bias voltage according to a control voltage.

2. Description of the Background Art

Bias voltage which changes depending upon input voltage $V_I$ is necessary, for example, in a voltage controlled oscillator (VCO). FIG. 7 is a block diagram showing the structure of a general voltage controlled oscillator. Referring to FIG. 7, the voltage controlled oscillator includes a ring oscillator 61 having three stages of inverters 62 connected to a power supply node 70 and a ground node 71 through current sources 63 and 64, and a bias generation circuit 51 for generating bias voltages $V_{BP}$ and $V_{BN}$ to control current sources 63 and 64, and the oscillation frequency f of the oscillator changes depending upon input voltage $V_I$. Power supply voltage $V_{DD}$ is applied to power supply node 70, and ground node 71 is grounded. A transistor forming a current mirror connection with a transistor in bias generation circuit 51 is generally used for current source 63, 64.

FIG. 8 is a circuit diagram showing the structure of bias generation circuit 51. Referring to FIG. 8, bias generation circuit 51 includes a P channel MOS transistor 55 connected in series between power supply node 70 and ground node 71, a first output node N51, an N channel MOS transistor 52, a resistor 53, a P channel MOS transistor 56 also connected in series between power supply node 70 and ground node 71, a second output node N52, and an N channel MOS transistor 57. The gates of P channel MOS transistors 55 and 56 are connected together to first output node N51, and the gate of N channel MOS transistor 57 is connected to second output node 52. P channel MOS transistor 55 and 56 constitute a current mirror circuit 54. The gate of N channel MOS transistor 52 is provided with input voltage $V_I$, and bias voltages $V_{BP}$ and $V_{BN}$ are output from first and second output nodes N51 and N52, respectively.

Assuming that P channel MOS transistors 55 and 56 are the same in size, and that bias current driven by N channel MOS transistor 52 is $I_B$, current through the path in the right, in other words current through P channel MOS transistor 56 and N channel MOS transistor 57 is $I_B$. A transistor constituting a current mirror connection with P channel MOS transistor 55 or N channel MOS transistor 57, in other words a transistor which uses bias voltage $V_{BP}$ or $V_{BN}$ as a gate voltage forms a current source r times as large as bias current $I_B$, where the ratio of the sizes of the transistors is r.

FIG. 9 is a graph showing the relation between input voltage $V_I$ and bias current $I_B$. As can be seen from FIG. 9, in the conventional bias generation circuit 51, in the region in which input voltage $V_I$ is larger than the threshold voltage $V_I$ of N channel MOS transistor 52, bias current $I_B$ increases linearly with increase in input voltage $V_I$, while in the region in which input voltage $V_I$ is smaller than the threshold voltage $V_{TN}$ Of N channel MOS transistor 52, bias current $I_B$ is cut off (null).

SUMMARY OF THE INVENTION

It is therefore a first object of the invention to provide a voltage controlled current source capable of outputting current depending upon control voltage even in a region in which the control voltage is smaller than the threshold voltage of an input transistor.

A second object of the invention is to provide a bias generation circuit capable of outputting bias voltage depending upon control voltage even in a region in which the control voltage is smaller than the threshold voltage of an input transistor.

Briefly stated, with a voltage controlled current source according to the present invention, since control voltage $V_I$ is input to first and second input transistors of different conductivity types, first current $I_P$ through the first input transistor decreases in response to control voltage $V_I$, and second current $I_N$ through the second input transistor increases in response to control voltage $V_I$ after control voltage $V_I$ exceeds the threshold voltage $V_{TH}$ of the input transistor. An operation circuit subtracts first current $I_P$ from prescribed current $I_{CONST}$ ($I_{CONST}-I_P$), and adds second current $I_N$ to the result ($I_{CONST}-I_P+I_N$). Therefore, if control voltage $V_I$ is at most at threshold voltage $V_{TH}$ and second current $I_N$ is 0, current which increases depending upon control voltage $V_I$ ($I_{CONST}-I_P$) can be output.

Preferably, the operation circuit is formed of a constant current source and first and second current mirror circuits, the first current mirror circuit subtracts first current $I_P$ from prescribed current $I_{CONST}$ output from the constant current source ($I_{CONST}-I_P$), and the second current mirror circuit adds to the resultant current ($I_{CONST}-I_P$) second current $I_N$ ($I_{CONST}-I_P+I_N$). The operation circuit can thus be readily configured.

More preferably, the first current mirror circuit subtract first current $I_P$ from prescribed current $I_{CONST}$ and multiplies the result by $\alpha$ ($\alpha I_{CONST}-\alpha I_P$), and the second current mirror circuit multiplies the resultant current ($\alpha I_{CONST}-\alpha I_P$) by $\beta$ and adds the result to second current $I_N$ ($\alpha\beta I_{CONST}-\alpha\beta I_P+I_N$). Therefore, appropriately setting $\alpha$ and $\beta$ can set a rising of output current ($\alpha\beta I_{CONST}-\alpha\beta I_P+I_N$) with respect to control voltage $V_I$ to a desired value.

Preferably, the first current mirror circuit multiples first current $I_P$ by $\alpha$ and subtracts the result from prescribed current $I_{CONST}$ ($I_{CONST}\alpha I_P$), and the second current mirror circuit multiplies the resultant current ($I_{CONST}-\alpha I_P$) by $\beta$ and adds the result to second current $I_N$ ($\beta I_{CONST}-\alpha\beta I_P+I_N$). Therefore, appropriately setting $\alpha$ and $\beta$ can set a rising of output current ($\beta I_{CONST}-\alpha\beta I_P+I_N$) relative to control voltage $V_I$ to a desired value.

Preferably, the first current mirror circuit subtracts first current $I_P$ from prescribed current $I_{CONST}$ and multiplies the result by $\alpha$ ($\alpha I_{CONST}-\alpha I_P$), and the second current mirror circuit multiplies second current $I_N$ and adds the result to the resultant current ($I_{CONST}-\alpha I_P$) ($\alpha I_{CONST}-\alpha I_P+\beta I_N$). Therefore, appropriately setting $\alpha$ and $\beta$ can set a rising of output current ($\alpha I_{CONST}-\alpha I_P+\beta I_N$) relative to control voltage $V_I$to a desired value.

Briefly stated, the bias generation circuit according to the present invention outputs bias voltage in response to the output current ($I_{CONST}-I_P+I_N$) of the voltage controlled current source. Therefore, if control voltage $V_I$ is at most at the threshold voltage $V_{TN}$ of the input transistor, current which increases depending upon control voltage $V_I$ can be output.

The operation circuit is preferably formed of a constant current source and first and second current mirror circuits. Thus, as is the case with the voltage controlled current source described above, the operation circuit can readily be configured.

Preferably, the output circuit is formed of a third current mirror circuit connected together with the output of the operation circuit to the first output node for outputting the output current of the operation circuit to the second output node, and an output transistor having an input electrode and an output electrode connected to the second node. Thus, first and second bias voltages depending upon control voltage $V_I$ can be output from the first and second output nodes, respectively.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
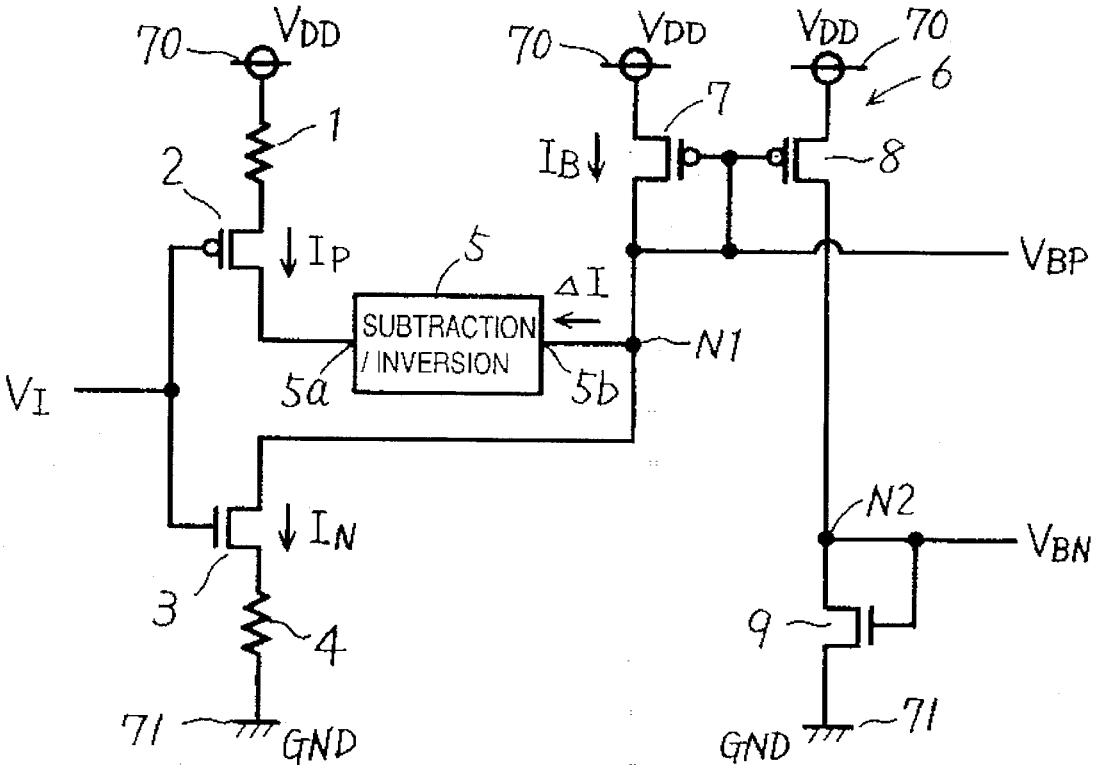
FIG. 1 is a block diagram showing the structure of a bias generation circuit according to a first embodiment of the invention.
Figure 2:
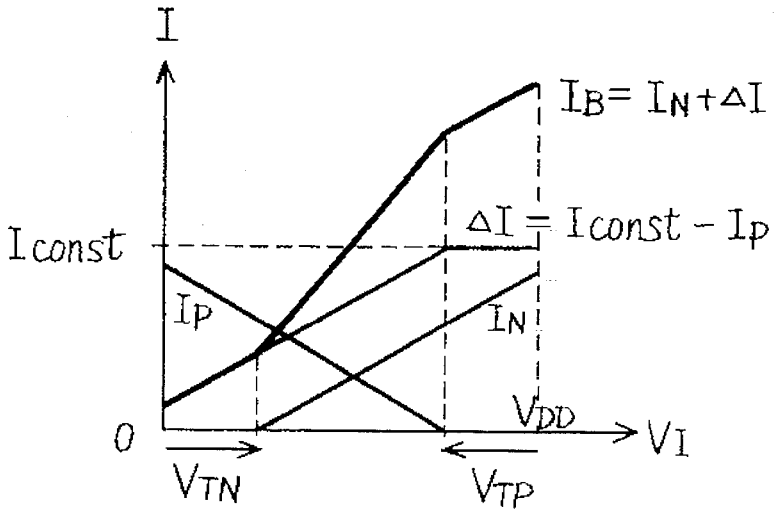
FIG. 2 is a graph showing the relation between input voltage $V_I$ and bias current $I_B$ in the bias generation circuit shown in FIG. 1.

FIG. 1 is a block diagram showing the structure of a bias generation circuit according to a first embodiment of the invention, and FIG. 2 is a graph showing the relation between input voltage $V_I$ and each current in the bias generation circuit. The bias generation circuit has input transistors arranged in a complementary manner, and one of the transistors is provided with current subtraction/inversion circuit 5.

More specifically, the bias generation circuit includes a P channel MOS transistor 2 (first input transistor), an N channel MOS transistor 3 (second input transistor), resistors 1 and 4, and subtraction/inversion circuit 5. Resistor 1 and P channel MOS transistor 2 are connected in series between a power supply node 70 and the input node **5*a* of subtraction/inversion circuit 5. N channel MOS transistor 3 and resistor 4 are connected in series between the output node 5*b* of subtraction/inversion circuit 5 and a ground node 71. Input voltage $V_I$ is input to the gates of P channel MOS transistor 2 and N channel MOS transistor 3**.

The bias generation circuit is also provided with an output circuit including P channel MOS transistors 7 and 8, and an N channel MOS transistor 9. P channel MOS transistor 7 is connected between power supply node 70 and a first output node N1 (the output node **5*b* of subtraction/inversion circuit 5), and P channel MOS transistor 8, a second output node N2, and N channel MOS transistor 9 are connected in series between power supply node 70 and ground node 71. The gates of P channel MOS transistors 7 and 8 are connected together to first output node N2, and the gate of N channel MOS transistor 9 is connected to second output node N2. Bias voltages $V_{BB}$ and $V_{BN}$ are output from first and second output nodes N1 and N2**, respectively.

Assuming that the threshold voltages of P channel MOS transistor 2 and N channel MOS transistor 3 are $V_{TP}$ and $V_I$, respectively, and that currents driven thereby are $I_P$ and $I_N$, respectively, current $I_P$ and current $I_N$ have inclinations opposite to each other as illustrated in FIG. 2. More specifically, current $I_P$ linearly decreases in the region in which input voltage $V_I$ is from 0 to $V_{DD}-V_{TP}$ and is nullified in the range from $V_{DD}-V_{TP}$ to $V_{DD}$. Meanwhile, current $I_N$ is 0 in the region in which input voltage $V_I$ is from 0 to $V_{TN}$ and linearly increases in the region from $V_{TN}$ to $V_{DD}$.

Then, a subtraction of $I_P$ from introduced constant current $I_{CONST}$ is conducted in subtraction/inversion circuit 5, and $\Delta I$ having an inclination in the same direction as $I_N$ is produced. Current produced by adding $I_N$ and $\Delta I$, in other words current through P channel MOS transistor 7 is designated as bias current $I_B$. Herein, $\Delta I$ is led to ground node 71 as is $I_N$, and therefore the directions of input current $I_P$ and output current $\Delta I$ are inverted in subtraction/inversion circuit 5. As illustrated in FIG. 2, for $I_{CONST}>I_P$, serially changing bias current $I_B$ in the range of input voltage $V_I$ from 0 to $V_{DD}$ is obtained. P channel MOS transistors 7 and 8 constitute a current mirror circuit 6, and if P channel MOS transistors 55 and 56 are the same in size, current through P channel MOS transistor 8 is also $I_B$. Therefore, a transistor constituting a current mirror connection with P channel MOS transistor 7 or N channel MOS transistor 9, in other words a transistor using bias voltage $V_{BP}$ or $V_{BN}$ as gate voltage forms a current source r times as large as bias current $I_B$, where the ratio of the sizes of the transistors is r.

As is the case with the conventional device, resistors 1 and 4 which are provided for making the $V_B$–$I_D$ characteristic of transistors 2 and 3 more linear may be omitted.

Second Embodiment

Figure 3:
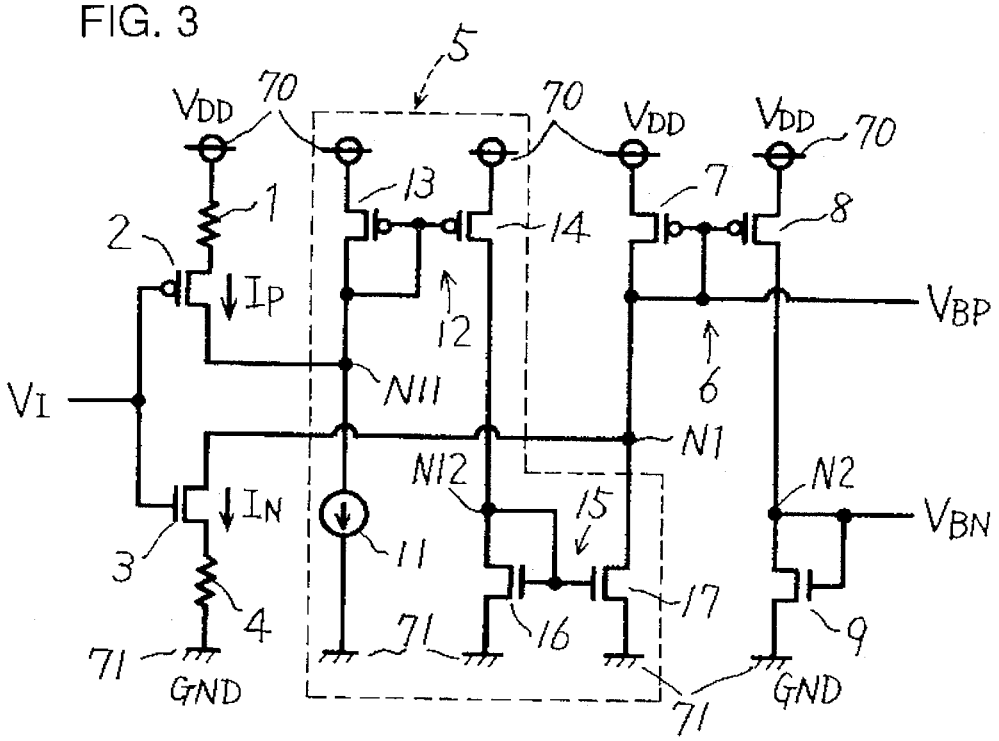
FIG. 3 is a block diagram showing the structure of a bias generation circuit according to a second embodiment of the invention.

FIG. 3 is a diagram showing the structure of a bias generation circuit according to a second embodiment of the invention. The bias generation circuit is a variation of the bias generation circuit shown in FIG. 1 with subtraction/inversion circuit 5 formed of transistors, wherein subtraction is followed by inversion.

More specifically, subtraction/inversion circuit 5 in the bias generation circuit includes a constant current source 11, and first and second current mirror circuits 12 and 15. First current mirror circuit 12 includes P channel MOS transistors 13 and 14, and second current mirror circuit 15 includes N channel MOS transistors 16 and 17.

P channel MOS transistor 13, a node N11 and constant current source 11 are connected in series between power supply node 70 and ground node 71, and node N11 is connected to the drain of P channel MOS transistor 2. P channel MOS transistor 14, a node N12, and N channel MOS transistor 16 are connected in series between power supply node 70 and ground node 71. N channel MOS transistor 17 is connected between first output node N1 and ground node 71. The gates of P channel MOS transistors 13 and 14 are connected to node N11, and the gates of N channel MOS transistors 16 and 17 are connected to node N12. The other structure is substantially identical to the bias generation circuit shown in FIG. 1, and therefore a description thereof is not provided.

In response to constant current $I_{CONST}$ supplied from current source 11, current $\Delta I=I_{CONST}-I_P$ is generated in P channel MOS transistor 13. P channel MOS transistors 13 and 14, and N channel MOS transistors 16 and 17 both establish a current mirror connection, and current through transistor 17 is also $\Delta I$ assuming that the ratios of the sizes of the transistors are both 1. If the ratios of the sizes of the transistors are r1 and r2, respectively, current through transistor 17 is $r1 \cdot r2 \cdot \Delta I$.

Third Embodiment

Figure 4:
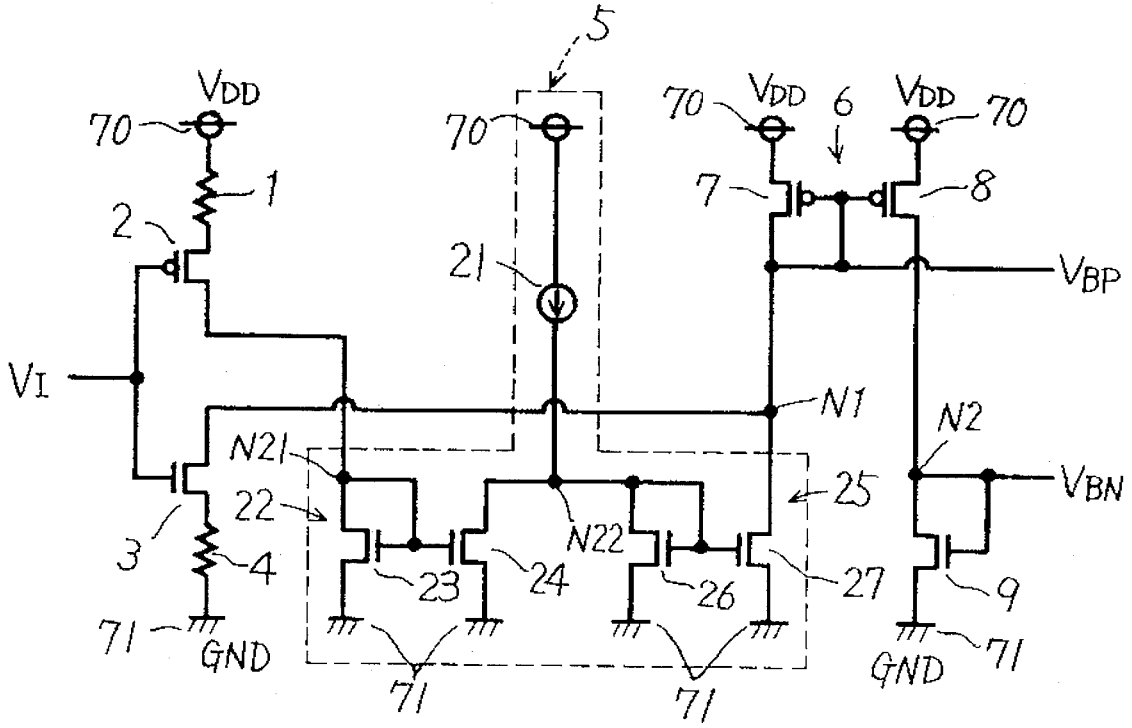
FIG. 4 is a block diagram showing the structure of a bias generation circuit according to a third embodiment of the invention.

FIG. 4 is a diagram showing the structure of a bias generation circuit according to a third embodiment of the invention. The bias generation circuit is a variation of the bias generation circuit shown in FIG. 1 with subtraction/inversion circuit 5 formed of transistors, wherein inversion is followed by subtraction.

More specifically, subtraction/inversion circuit 5 in the bias generation circuit includes a constant current source 21, first and second current mirror circuits 23 and 26. First current mirror circuit 22 includes N channel MOS transistors 23 and 24, and second current mirror circuit 25 includes N channel MOS transistors 26 and 27.

N channel MOS transistors 23 and 24 are connected between nodes N21 and N22 and ground node 71, respectively, and the gates of N channel MOS transistors 23 and 24 are connected together to a node N21. Node N21 is connected to the drain of P channel MOS transistor 2, and node N22 is connected to power supply node 70 through constant current source 21. N channel MOS transistors 26 and 27 are connected between nodes N22 and N1 and ground node 71, respectively, and the gates of N channel MOS transistors 26 and 27 are connected together to node N22. The other structure is substantially identical to the bias generation circuit shown in FIG. 1, and therefore a description thereof is not provided.

N channel MOS transistors 23 and 24 form a current mirror connection, and current through transistor 24 is also $I_P$ assuming that the ratio of transistor sizes is 1. In response to constant current $I_{CONST}$ supplied from constant current source 21, $\Delta I$ is generated in N channel MOS transistor 26. N channel MOS transistors 26 and 27 form a current mirror connection, and current through transistor 27 is also $\Delta I$ assuming that the ratio of transistor sizes is 1. If the ratio of the transistor sizes of transistors 23 and 24 is r1, $\Delta I=I_{CONST}-r1 \cdot I_P$ holds, while if the ratio of the transistor sizes of transistor 6 and 27 is r2, current through transistor 27 is $r2 \cdot \Delta I$.

Fourth Embodiment

Figure 5:
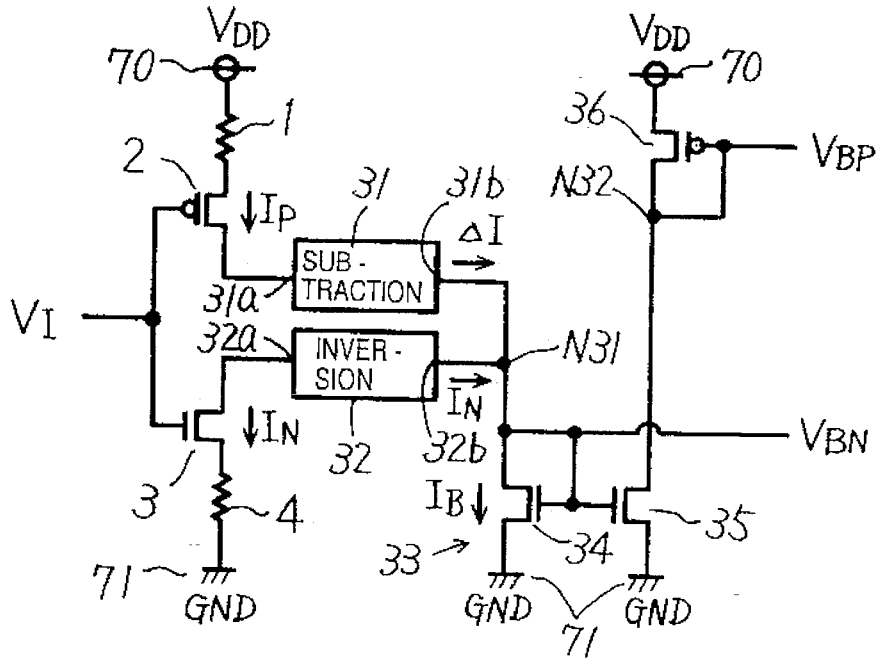
FIG. 5 is a block diagram showing the structure of a bias generation circuit according to a fourth embodiment of the invention.

FIG. 5 is a block diagram showing a bias generation circuit according to a fourth embodiment of the invention. The bias generation circuit has input transistors arranged in a complementary manner, and one of the transistors is provided with a current subtraction circuit 31 and the other with a current inversion circuit 32.

More specifically, the bias generation circuit includes a P channel MOS transistor 2, an N channel MOS transistor 3, resistors 1 and 4, current subtraction circuit 32*a* and current inversion circuit 32. Resistor 1 and P channel MOS transistors 2 are connected in series between a power supply node 70 and the input node 31*a* of current subtraction circuit 31. N channel MOS transistor 3 and resistor 4 are connected in series between the input node 32*a* of current inversion circuit 32 and a ground node 71. The output node 31*b* of current subtraction circuit 31 and the output node 32*b* of current inversion circuit 32 are connected together to first output node N31.

The bias generation circuit further includes an output circuit formed of N channel MOS transistors 34 and 35, and a P channel MOS transistor 36. N channel MOS transistors 34 and 35 are connected between first and second output nodes N31 and N32 and ground node 71, respectively, and the gates of N channel MOS transistors 34 and 35 are connected together to first output node N31. More specifically, N channel MOS transistors 34 and 35 constitute a current mirror circuit 33. P channel MOS transistor 36 is connected between power supply node 70 and second output node N32, with its gate being connected to second output node N32.

Input voltage $V_I$ is provided to the gates of P channel MOS transistor 2 and N channel MOS transistor 3, and bias voltages $V_{BN}$ and $V_{BP}$ are output from first and second output nodes N31 and N32, respectively.

The relation between the input voltage $V_I$ of the bias generation circuit and each current is the same as the relation shown in FIG. 2. In subtraction circuit 31, constant current $I_{CONST}$ is introduced, $I_P$ is subtracted therefrom, and $\Delta I$ is produced. $I_N$ and $\Delta I$ are added to produce bias current $I_B$. Herein, $I_N$ and $\Delta I$ are both provided from power supply node 70, and therefore the direction of current $I_N$ is inverted in inversion circuit 32. N channel MOS transistors 34 and 35 constitute a current mirror connection, and if their transistor sizes are the same, current through transistor 35 is also $I_B$. Accordingly, a transistor establishing a current mirror connection with N channel MOS transistor 34 or P channel MOS transistor 36, in other words a transistor using bias voltage $V_{BN}$ or $V_{BP}$ as gate voltage forms a current source r times as large as bias current $I_B$, assuming that the ratio of transistors sizes is r.

In the circuit one of the complementary input transistors is provided with current subtraction circuit 31, the other with current inversion circuit 32, so that the functions of current subtraction and current inversion are separated, and therefore delay until bias current $I_B$ is produced by addition can be reduced.

Fifth Embodiment

Figure 6:
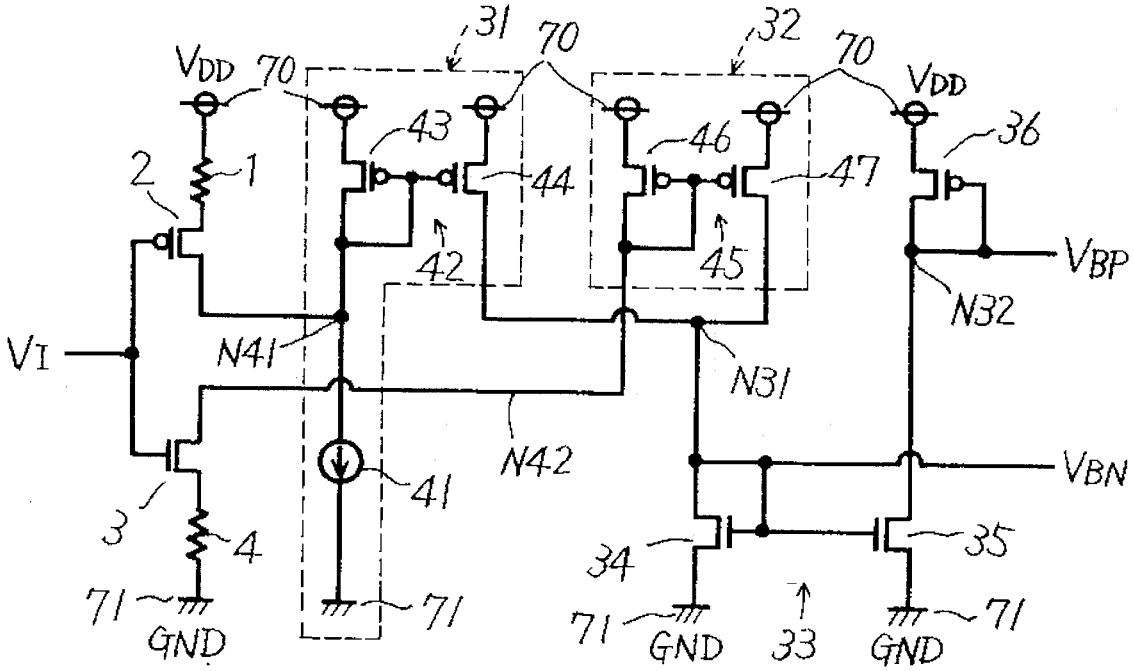
FIG. 6 is a diagram showing the structure of a bias generation circuit according to a fifth embodiment of the invention.
Figure 7:
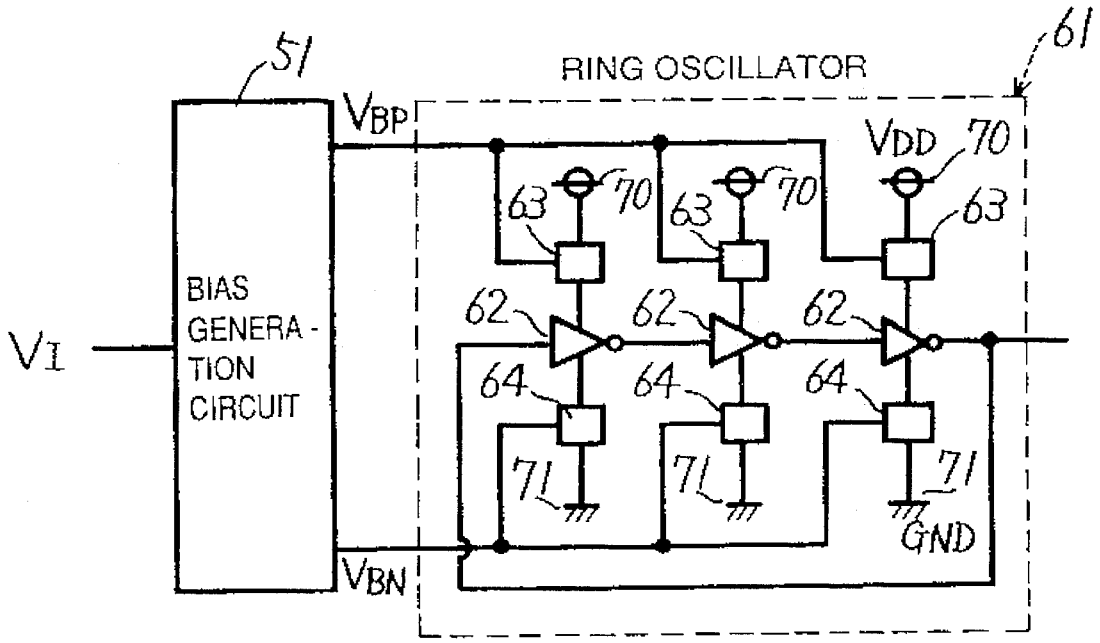
FIG. 7 PRIOR ART
FIG. 7 is a block diagram showing the structure of a general voltage controlled oscillator including a bias generation circuit.
Figure 8:
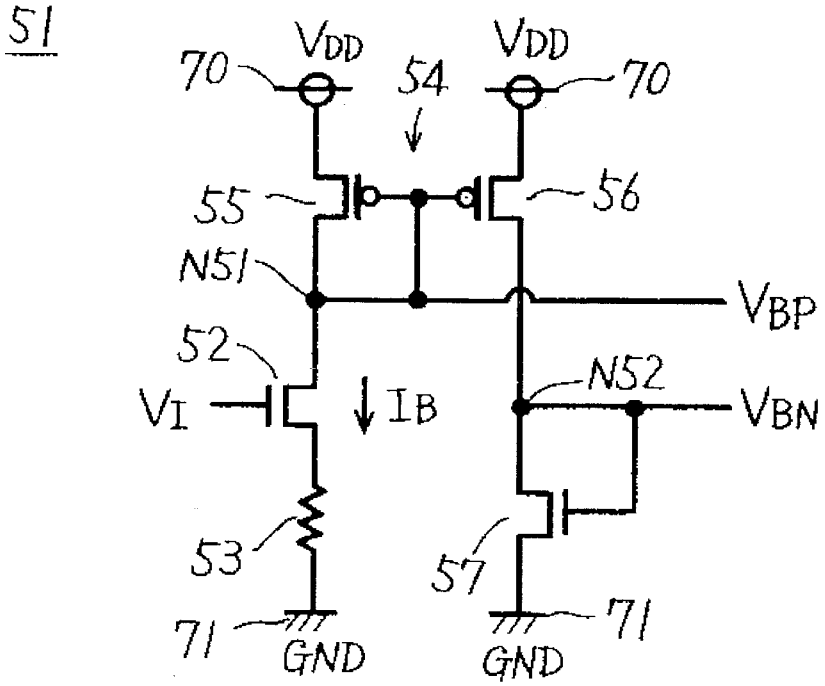
FIG. 8 PRIOR ART
FIG. 8 is a diagram showing the structure of the bias generation circuit in the voltage controlled oscillator shown in FIG. 7.
Figure 9:
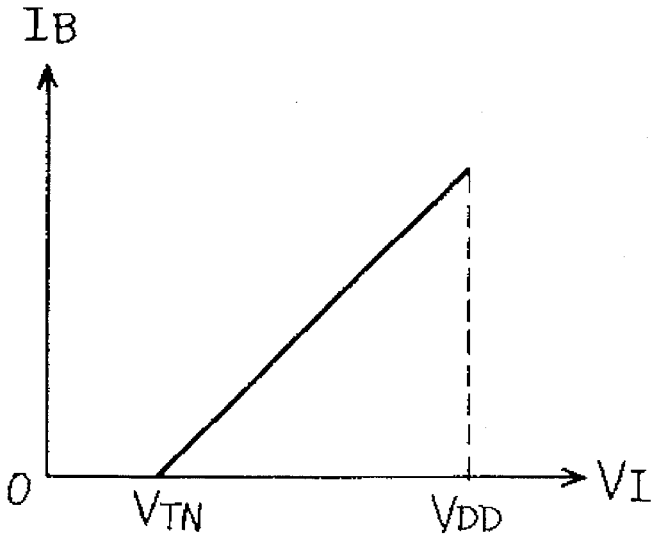
FIG. 9 PRIOR ART
FIG. 9 is a graph showing the relation between input voltage $V_I$ and bias current $I_B$ in the bias generation circuit shown in FIG. 8.

FIG. 6 is a diagram showing the structure of a bias generation circuit according to a fifth embodiment of the invention. The bias generation circuit is a variation of the bias generation circuit shown in FIG. 5 with subtraction circuit 31 and inversion circuit 32 being formed of transistors.

More specifically, subtraction circuit 31 includes a current mirror circuit 42 and a constant current source 41, and first current mirror circuit 42 includes P channel MOS transistors 43 and 44. P channel MOS transistor 43 and 44 are connected between power supply node 70 and nodes N41 and N31, respectively, and the gates of P channel MOS transistors 43 and 44 are connected together to node N41. Constant current source 41 is connected between node N41 and ground node 71, and node N41 is connected to the drain of P channel MOS transistor 2.

Inversion circuit 32 includes a second current mirror circuit 45, which includes P channel MOS transistors 46 and 47. P channel MOS transistors 46 and 47 are connected between power supply node 70 and nodes N42 and N31, respectively, and the gates of P channel MOS transistors 46 and 47 are connected together to node N42. Node N42 is connected to the drain of N channel MOS transistor 3.

In response to constant current $I_{CONST}$ supplied from current source 41, $\Delta I$ is generated in P channel MOS transistor 43. P channel MOS transistors 43 and 44 constitute a current mirror connection, and assuming that the ratio of transistor sizes is 1, current through transistor 44 is also $\Delta I$. Meanwhile, P channel MOS transistors 46 and 47 also establish a current mirror connection, and assuming that the ratio of transistor sizes is 1, current through transistor 47 is $I_N$. If the ratios of the transistor sizes are $r_1$ and $r_2$, respectively, currents through transistors 44 and 47 are $r_1 \cdot \Delta I$ and $r_2 \cdot I_N$, respectively.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A voltage controlled current source for outputting a current depending upon a control voltage, comprising:

a first input transistor of a first conductivity type, having a first electrode coupled to a first power supply potential, a control electrode for receiving said control voltage, and a second electrode for providing a first current depending upon the control voltage;

a second input transistor of a second conductivity type, having a first electrode coupled to a second power supply potential, a control electrode for receiving said control voltage, and a second electrode for providing a second current depending upon the control voltage; and an operation circuit coupled to the second electrodes of said first and second input transistors, said circuit including, a constant current source for passing a prescribed current, circuitry for subtracting the first current provided by said first input transistor from said prescribed current and adding the second current provided by said second input transistor to the result of said subtraction, and an output node for outputting an output current resulting from said addition.

2. A voltage controlled current source as recited in claim 1, wherein said circuitry includes, a first current mirror circuit for subtracting the first current provided by said first input transistor from the prescribed current output from said constant current source, and a second current mirror circuit for adding the second current provided by said second input transistor and an output current from said first current mirror circuit.

3. A voltage controlled current source as recited in claim 2, wherein the second electrode of said first input transistor and said constant current source are connected to a first node, the second electrode of said second input transistor is connected to said output node, said first current mirror circuit is connected between said first node and a second node, and subtracts the first current provided by said first transistor from the prescribed current output from said constant current source and multiplies the result of said subtraction by $\alpha$ for output to said second node, and said second current mirror circuit is connected between said second node and said output node, and multiplies the current provided by said second node by $\beta$ for addition to the second current provided by said second input transistor, where $\alpha$ and $\beta$ represent the ratios of current amplification for said first and second current mirror circuits, respectively.

4. A voltage controlled current source as recited in claim 2, wherein the second electrode of said first input transistor is connected to a first node, said constant current source is connected to a second node, the second electrode of said second transistor is connected to the output node, said first current mirror circuit is connected between said first node and said second node, multiplies the first current provided by said first input transistor by $\alpha$ and subtracts the result from the prescribed current output from said constant current source, and said second current mirror circuit is connected between said second node and said output node, multiplies the current provided by said second node by $\beta$ and adds the result to the second current provided by said second input transistor, where $\alpha$ and $\beta$ represent the ratios of current amplification for said first and second current mirror circuits, respectively.

5. A voltage controlled current source as recited in claim 2, wherein the second electrode of said first input transistor and said constant current source are connected to a first node, the second electrode of said second input transistor is connected to a second node, said first current mirror circuit is connected between said first node and said output node, subtracts the first current provided by said first input transistor from the prescribed current output from said constant current source, multiplies the result of said subtraction by $\alpha$ for output to said output node, and said second current mirror circuit is connected between said second node and said output node, multiplies the second current provided by said second input transistor by $\beta$ and adds the result to the current provided by said output node, where $\alpha$ and $\beta$ represent the ratios of current amplification for said first and second current mirror circuits, respectively.

6. A bias generation circuit for outputting one or more bias voltages depending upon a control voltage, comprising:

a first input transistor of a first conductivity type, having a first electrode coupled to a first power supply potential, a control electrode for receiving said control voltage, and a second electrode for providing a first current depending upon the control voltage, a second input transistor of a second conductivity type, having a first electrode coupled to a second power supply potential, a control electrode for receiving said control voltage, and a second electrode for providing a second current depending upon the control voltage;

an operation circuit coupled to the second electrodes of said first and second input transistors, said circuit including, a constant current source for passing a prescribed current, circuitry for subtracting the first current provided by said first input transistor from said prescribed current, and adding the second current provided by said second input transistor to the result of said subtraction, a first output node for outputting an output current resulting from said addition, and an output circuit coupled to said first output node for outputting said one or more bias voltage depending upon the output current of said operation circuit.

7. A bias generation circuit as recited in claim 6, wherein said circuitry includes, a first current mirror circuit for subtracting the first current provided by said first input transistor from the prescribed current output from said constant current source, and a second current mirror circuit for adding the second current provided by said second input transistor and an output current from said first current mirror circuit.

8. A bias generation circuit as recited in claim 6, wherein said output circuit includes a third current mirror circuit connected to said first output node, for outputting the output current from said operation circuit to a second output node, and an output transistor having a control electrode and a pair of output electrodes, wherein said control electrode and one of said pair of output electrodes are connected to said second output node.

* * * * *